United States Patent [19]

Evälahti

[11] 3,953,284

[45] Apr. 27, 1976

[54] DEWATERING BLADE LOCKING ASSEMBLY

[75] Inventor: Osmo Rainer Evälahti, Karhula, Finland

[73] Assignee: A. Ahlstrom Osakeyhtio, Finland

[22] Filed: Aug. 8, 1974

[21] Appl. No.: 495,772

[30] Foreign Application Priority Data

Aug. 15, 1973 Finland ..... 2563/73

[52] U.S. Cl. ..... 162/352; 162/374

[51] Int. Cl.[2] ..... D21F 1/48

[58] Field of Search ..... 162/351, 352, 363, 374, 162/367, 279, 211

[56] References Cited

UNITED STATES PATENTS

| | | | |
|---|---|---|---|
| 3,017,930 | 1/1962 | Dunlap | 162/352 |
| 3,337,394 | 8/1967 | White et al. | 162/352 |
| 3,393,124 | 7/1968 | Klingler et al. | 162/352 |
| 3,520,775 | 7/1970 | Truxa | 162/352 |
| 3,576,716 | 4/1971 | Reynolds et al. | 162/352 |
| 3,577,316 | 5/1971 | Piette | 162/352 |
| 3,645,844 | 2/1972 | Grenier | 162/352 |
| 3,647,620 | 3/1972 | Truxa | 162/352 X |
| 3,743,574 | 7/1973 | Walser et al. | 162/352 |

*Primary Examiner*—S. Leon Bashore
*Assistant Examiner*—Marc L. Caroff
*Attorney, Agent, or Firm*—Bucknam and Archer

[57] ABSTRACT

A dewatering device for paper machines is disclosed as comprising a supporting member adapted to be attached substantially transversally below the horizontal paper machine wire and a water removal blade to be fitted in its longitudinal direction on top of the supporting member, the supporting member having means which supports the water removal blade and locking means, as well as means for moving the supporting and locking means in relation to each other in vertical direction so that the lower part of the dewatering blade can be pressed between the supporting and the locking means.

4 Claims, 5 Drawing Figures

DEWATERING BLADE LOCKING ASSEMBLY

BACKGROUND OF THE INVENTION

The present invention relates to a dewatering device for paper machines, comprising a supporting member meant to be attached substantially transversally below the horizontal paper machine wire and a water removal blade to be fitted on top of it by means of a sliding joint.

Previously known is a stationary paper machine dewatering device for removing liquid from the horizontal wire. One especially common has been a water removal device the front part of which extends transversally in regard to the running direction of the machine to support the wire, and the supporting part of which forms an angle with the wire so that when the wire moves a vacuum is created under the wire, sucking water from the stock track.

Owing to the wear caused by the wire, the water removal device must either be made from a very expensive material, e.g., a ceramic one, or it must be easy to replace. Canadian Patent 666,214 can be mentioned as one example of the latter alternative. In it the water removal blade has been dovetailed to its support so that it can be drawn out of the machine, sliding along the support.

There is a problem connected with such a replaceable water removal blade. If the joint between the support and the water removal blade is slack in order that the blade be easy to replace, the joint is not stable but the angle between the blade and the wire can change during the operation and is susceptible to vibration. If the joint is very tight so that the blade will not move during the operation, the blade is difficult to replace. A considerable disadvantage lies in that the temperatures of the stocks for different qualities of paper are different. Since the heat expansion of HD-polyethylene and that of steel are different, a clearance suitable when the operation takes place at the temperature of one type of stock may become slack when the operation takes place with a stock at a different temperature.

The object of the invention is to eliminate the above disadvantage and provide a water removal device attachment mechanism by means of which the water removal blade is easy to replace but stays firmly in place in the operating position.

SUMMARY OF THE INVENTION

According to the invention there is provided a new and useful dewatering device with a dewatering blade adapted to contact the wire in a substantially transversal direction thereto and designed for longitudinal slidable attachment on top of a supporting member adapted to be attached to the frame below the wire, said supporting member having means for supporting the dewatering blade, locking means, and means for vertically adjusting the supporting and locking means in relation to each other for pressing the lower portion of the blade between the supporting and locking means.

In a water removal device according to the invention a conventional water removal blade is thus used, which has in its lower side a groove in the longitudinal direction of the blade, and two flanges pointing towards each other border the groove. The water removal blade is attached on top of the supporting member, which has a supporting part on which the flanges of the water removal blade rest and a locking part which extends to the groove of the water removal blade over the two flanges so that in its longitudinal direction the water removal blade can be slid over the supporting member and attached firmly to it by pressing the two flanges of the water removal blade between the supporting part and the locking part. The supporting part and the locking part must therefore be movable in the vertical direction in relation to each other.

According to the invention, either the supporting part or the locking part may be movable while the other one is stationary, or they may both be movable in the vertical direction.

The supporting part is preferably a rail with a U-shaped cross section, which has been attached to the frame and inside which has been fitted a rail with a T-shaped cross section, which works as the locking part and can be moved in the vertical direction, whereby each flange of the water removal blade slid over the T-shaped rail can be pressed between the horizontal flanges of the T-shaped rail and the vertical flanges of the U-shaped rail.

Alternatively, the locking member with a T-shaped cross section can, of course, be attached to the frame, in which case a member with an expandable cross section area, e.g., a tubular piece made from a resilient material, connected to a pressure medium source, is fitted between the frame and each flange of the water removal blade, and when this member expands it presses the flanges of the water removal blade upwards against the horizontal arms of the T-shaped locking part.

DESCRIPTION OF THE PREFERRED EMBODIMENTS

Figure 1:
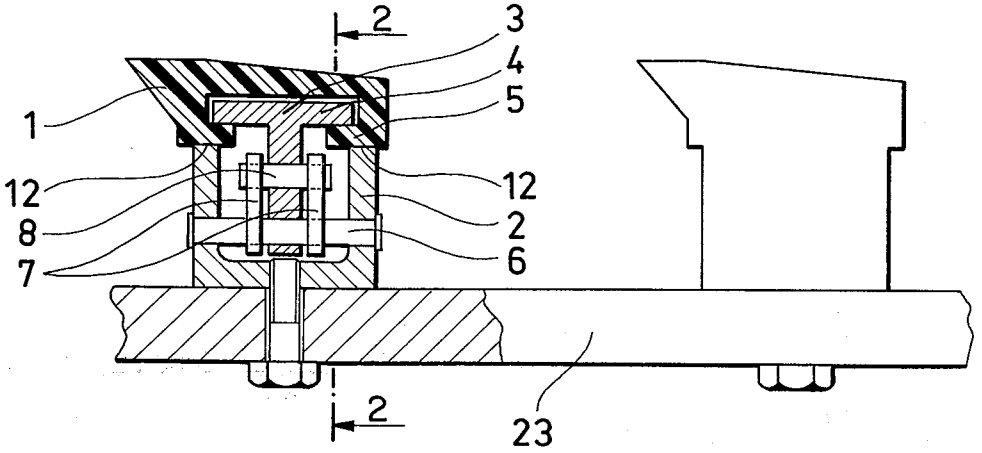
FIG. 1 shows a partially cut side view of a preferred embodiment of the invention.
Figure 2:
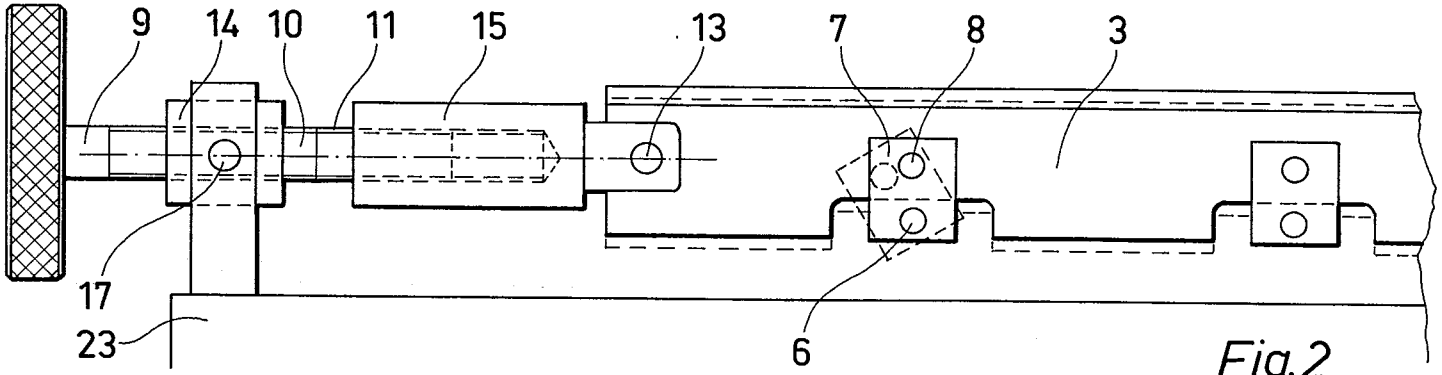
FIG. 2 shows a section along line 2—2 in FIG. 1.

In FIG. 1, the frame of the horizontal machine wire part is indicated by 23 and bars 2 with a U-shaped cross section have been attached with bolts at intervals on top of the frame 23, transversally as seen in the running direction of the wire, (not shown) and below the wire. The longitudinal flanges 5 of the water removal blade 1, the flanges being situated on its lower side and pointing towards each other, rest on the upper surface of the flanges of the U-bar 2, which works as a supporting member, or on its supporting part 12.

In the space delimited by the water removal blade 1 and the U-bar 2 has also been fitted a rail 3 with a T-shaped cross section, of which the horizontal flanges extend over the flanges 5 of the water removal blade and the waist part of which extends downwards inside the U-bar 2.

The T-rail 3, which works as a locking part, has been connected operationally to the U-bar by means of a lever arm system, in which lever arms 7, which convert the reciprocal movement of the T-rail into a vertical one, have been attached at regular intervals on both sides of the waist part of the T-rail in its longitudinal direction, their upper ends having been attached to the waist part by means of pins 8 and their lower ends to the U-rail by means of pins 6 so that they can turn.

The said reciprocal or longitudinal movement is produced by turning the screw 9, which has two parts 10 and 11 threaded in opposite directions and screwed to the nuts 14 and 15, which have been attached to the pins 17 and 13, so that they can turn. When the T-rail 3 is moved longitudinally by means of the screw 9, the T-rail 3 rises or falls simultaneously owing to its articulated mechanism.

Figure 4:
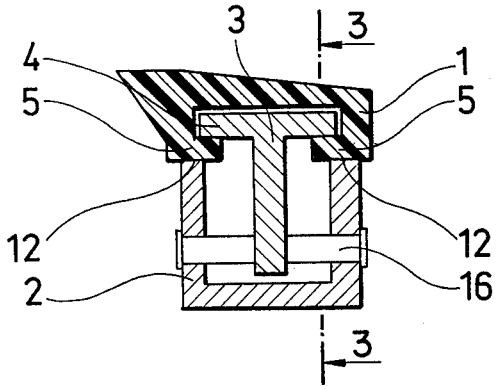
FIG. 4 shows a cut side view of another embodiment.
Figure 3:
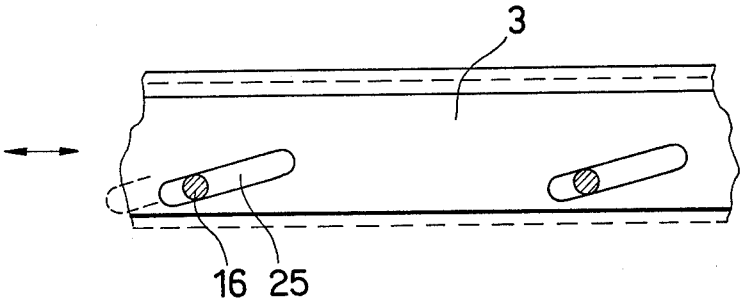
FIG. 3 shows a section along line 3—3 in FIG. 4.

FIGS. 3 and 4 show a device similar to that shown in FIG. 1 with the difference that instead of using the lever arms 7 the vertical movement of the T-rail 3 has been achieved by means of a horizontal pin 16 which extends between the vertical flanges of the U-bar; the pin 16 also runs through the slanted oblong opening 25 in the waist part of the T-rail 3, whereby the stationary pin 16 forces the T-rail 3 either to rise or fall when the T-rail 3 is moved in its longitudinal direction.

Figure 5:
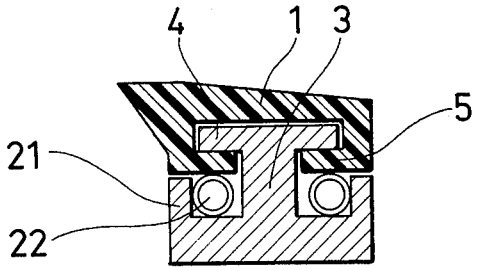
FIG. 5 shows as a cross section an alternative embodiment deviating from the previous ones.

The water removal device according to FIG. 5 deviates from those described above in the respect that in this embodiment the T-rail which works as a locking member is stationary and on both sides its lower part has grooves 21 in which have been fitted resilient tubes 22, which have been connected to a pressure medium source (not shown) and which, when under pressure, press the flanges 5 of the water removal blade 1 fitted on top of the T-shaped rail 3 upwards against the horizontal flanges of the T-rail, whereby the blade stays firmly in place. When the pressure is removed, the water removal blade 1 can easily be drawn out in the longitudinal direction of the blade.

What is claimed is:

1. A dewatering device for paper machines comprising a rigid frame and an endless wire on said frame, said device including a dewatering blade in contact with the wire in a substantially transversal direction thereto, a supporting member attached to the frame below the wire, said dewatering blade in longitudinal slidable attachment on top of said supporting member, said supporting member having means for supporting the dewatering blade, locking means, and means for vertically adjusting the supporting and locking means in relation to each other for pressing the lower portion of the blade between the supporting member and locking means, the locking means being a rail with a substantially T-shaped cross section, the lower side of the dewatering blade having two flanges pointing towards each other in the longitudinal direction of the blade and fitted to extend under the arms of the rail of T-shaped cross section so that the flanges rest on the supporting means, the supporting means being a U-shaped rail inside which the locking member has been fitted, and the means for vertically adjusting the supporting member and locking means in relation to each other are lever arms, the upper ends thereof being connected to said locking means, the lower ends thereof being connected to said U-shaped rail.

2. The device according to claim 1 wherein one of said supporting member and locking means is movable in the vertical direction and the other is stationary.

3. The device according to claim 1 wherein both said supporting member and said locking means are movable in the vertical direction.

4. The dewatering device of claim 1, in which the supporting member is stationary and the locking means is vertically adjustable.

* * * * *